United States Patent [19]

Parlman et al.

[11] 4,424,122

[45] Jan. 3, 1984

[54] GOLD FLOTATION WITH MERCAPTAN AND IMIDAZOLINE

[75] Inventors: Robert M. Parlman; Clarence R. Bresson, both of Bartlesville, Okla.

[73] Assignee: Phillips Petroleum Company, Bartlesville, Okla.

[21] Appl. No.: 369,674

[22] Filed: Apr. 19, 1982

[51] Int. Cl.[3] ..... B03D 1/14

[52] U.S. Cl. ..... 209/166; 209/167; 252/61; 548/341

[58] Field of Search ..... 209/166, 167; 252/61; 548/341

[56] References Cited

U.S. PATENT DOCUMENTS

| | | | |
|---|---|---|---|
| 2,781,352 | 2/1957 | De Groote et al. . | |
| 3,009,575 | 11/1961 | Keen et al. | 209/166 |
| 3,265,211 | 8/1966 | Wheaton et al. . | |
| 3,555,041 | 1/1971 | Katz . | |
| 3,595,390 | 7/1971 | Booth | 209/166 |
| 4,211,644 | 7/1980 | Wiechers | 252/61 |
| 4,342,648 | 8/1982 | Biss et al. | 209/166 |

FOREIGN PATENT DOCUMENTS

| | | | |
|---|---|---|---|
| 523895 | 4/1956 | Canada | 252/61 |
| 1056072 | 6/1979 | Canada | 209/166 |

*Primary Examiner*—Bernard Nozick

[57] ABSTRACT

A composition comprising a mercaptan, an imidazoline and a frother has been found to synergistically increase gold recovery over the recovery achievable with mercaptan and imidazoline alone.

10 Claims, No Drawings

GOLD FLOTATION WITH MERCAPTAN AND IMIDAZOLINE

This invention relates to mineral recovery by flotation operations. More specifically the invention relates to a new composition comprising two flotation ingredients and a frother. Another aspect of this invention relates to an ore flotation process, particularly one in which gold is recovered.

BACKGROUND OF THE INVENTION

Flotation processes are known in the art and are used for recoverying and concentrating minerals from ores. In froth flotation processes the ore is crushed and wet ground to obtain a pulp. Additives such as mineral flotation or collecting agents, frothers, suppressants, stabilizers, etc. are added to the pulp to assist separating valuable materials from the undesired or gangue portions of the ore in subsequent flotation steps. The pulp is then aerated to produce a froth at the surface. The minerals which adhere to the bubbles or froth are skimmed or otherwise removed and the mineral bearing froth is collected and further processed to obtain the desired minerals. Typical mineral flotation collectors include xanthates, amines, alkyl sulfates, arene sulfonates, dithiocarbamates, dithiophosphates and thiols.

U.S. Pat. No. 3,555,041 describes imidazoline surfactants and mentions the use of alkali propionates of imidazoline compounds as flotation agents. U.S. Pat. No. 3,265,211 mentions that imidazolines can be used as collectors and that the use of neutralized amine collectors facilitates the dispersability in water. U.S. Pat. No. 4,211,644 describes the use of mercaptan collectors and specifically the use of dodecyl mercaptan in copper flotation.

While the art of ore flotation has reached a significant degree of sophistication it is a continuing goal in the ore recovery industry to increase the productivity of ore flotation processes and above all to provide specific processes which are selective to one ore or to one metal over other ores or other metals, respectively, which are present in the treated material.

THE INVENTION

It is thus one object of this invention to provide a new composition which is useful in ore flotation.

Another object of this invention is to provide a flotation process.

Yet a further object of this invention is to provide an improved flotation process using the new composition to improve the recovery of gold values from ores containing mineralized gold.

These and other objects, advantages, details, features and embodiments of this invention will become apparent to those skilled in the art from the following detailed description of the invention and the appended claims.

In accordance with this invention it has now been found that a composition comprising a mercaptan having 12 to 16 carbon atoms and an imidazoline being substituted by an alkyl or alkenyl radical having 7 to 21 carbon atoms and a frother constitutes a new composition which is useful particularly as a flotation and frothing agent in the recovery of gold.

In accordance with a first embodiment of this invention therefore a novel composition of matter is provided which comprises and preferably consists essentially of the following ingredients:

(a) a mercaptan having the formula $$R'—SH$$

wherein R' is an alkyl radical having 12 to 16 carbon atoms, (b) an imidazoline have the formula

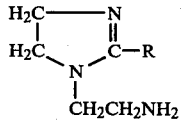

wherein R is an alkyl or alkenyl radical having from 7 to 21 carbon atoms, said imidazoline being present in the composition as such or in the form of the quarternary ammonium salt thereof, (c) a frother.

MERCAPTAN

The mercaptan employed in the composition of this invention is an alkyl mercaptan having 12 to 16 carbon atoms. Exemplary of such materials are 1-dodecanethiol (n-dodecyl mercaptan), 2-dodecanethiol (sec-dodecyl mercaptan), 2,4,6,8,10-pentamethyl-2-heptanethiol (commonly referred to as tert-dodecyl mercaptan and generally present in a mixture of isomers), and 1-hexadecanethiol (hexadecyl mercaptan).

The mercaptan portion of the instant invention is preferably a blend of 80 wt. % mercaptan and 20 wt. % frother. This blend is also commercially available.

IMIDAZOLINE

The imidazolines useful in this invention are alkyl or alkenyl substituted compounds. The alkyl radical has 7 to 21 carbon atoms. Examples for such materials are 1-beta aminoethyl-2-heptenyl imidazoline
1-beta aminoethyl-2-octyl imidazoline
1-beta aminoethyl-2-decyl imidazoline
1-beta aminoethyl-2-dodecyl imidazoline
1-beta aminoethyl-2-dodecenyl imidazoline
1-beta aminoethyl-2-tetradecyl imidazoline
1-beta aminoethyl-2-hexadecyl imidazoline
1-beta aminoethyl-2-heptadecyl imidazoline
1-beta aminoethyl-2-eicosyl imidazoline and the like and mixtures thereof. Also the corresponding amine salts are useful. Such salts are derived from inorganic acids like HCl, HBr, $HNO_3$, $H_2SO_4$, $H_3PO_4$, HI, and organic halides like methyl chloride, methyl iodide, ethyl chloride and other such reagents known to form quaternary ammonium salts.

FROTHER

The preferred forthing agents also referred to as dispersants or wetting agents which are combined with the mercaptan and useful in this invention are represented by the formula $$HO\text{-}(CHR^2\underset{\underset{CH_3}{|}}{C}H—O)_x—R^2$$

where the radicals $R^2$ which can be the same or different are hydrogen, methyl or ethyl radicals and x is a number from 6 to 17. Typical compounds representing these type materials are, for example, but not limited to such materials as polypropylene glycol 400
polypropylene glycol 425
polypropylene glycol 750
polypropylene glycol 900
polybutylene glycol
polypentylene glycol
along with the corresponding monomethyl and monoethyl ethers and the like and mixtures thereof. The numbers following the names are the average molecular weight of the products. The molecular weight of these polyoxyalkylene glycols and ethers can be broadly from about 400 to about 1000 although the preferred molecular weight range is from about 425 to about 772.

BLENDS, WEIGHT RATIOS

The amount of frothing agent employed will in general depend on the amount of mercaptan collector employed. Usually the weight ratio of mercaptan collecting agent to frothing agent will be from about 6:1 to 3:1.

The usually employed weight ratio of imidazoline:-mercaptan/frother blend is 10:90 to 90:10 and preferably 35:65 to 65:35. In the specific examples of the instant invention the ratio mentioned was 58:42.

FLOTATION PROCESS

In accordance with another embodiment of this invention a flotation process is provided. This flotation process involves the steps of (a) mixing the mineral material with water and the composition defined above to establish a pulp,
(b) aerating the pulp to produce a froth and a tail product,
(c) separating the froth and the tail product and
(d) recovering minerals from the so separated froth and/or tail product.

The process steps here involved are conventional except for the novel composition used as collector and frother in combination as defined above. Although the mercaptan collector, imidazoline collector and frother can be added separately during the froth flotation, it is preferred that all three ingredients be premixed, blended or otherwise combined before using. The amount of combined imidazoline/mercaptan/frother composition employed will generally be from about 0.005 lbs/ton ore to 0.5 lbs/ton ore (or concentrate or other mining deposit).

METAL BEARING ORES

The composition of this invention is useful for a variety of minerals. The composition is, however, particularly useful for recovering mineral values from ores that have been sulfided. The presently preferred recovery process with the composition of this invention involves recovery of gold from gold bearing ores. Examples of such gold bearing ores are silvanite ($AuAgTe_2$) and calaverite (AuTe).

The following examples serve to further illustrate the invention as well as to show further preferred embodiments thereof without undue limitation to its scope.

EXAMPLE I

This example is a control describing a standard ore flotation process procedure used herein to evaluate mining chemicals. The example employs a known collector. To a ball mill was charged 1000 grams of wet gold-containing ore from Venderspost Mines, South Africa and enough water to make a 55 weight percent solids slurry. The mixture was ground for 13 minutes to give a particle size distribution of 45% +200 Tyler mesh screen size. The mixture was transferred to a Denver D-12 flotation cell along with enough water to make a 32 weight percent aqueous solids mixture. The pH was adjusted to 11.0 with calcium oxide. A frother (polypropylene glycol monomethyl ether, MW 200) (Dowfroth 200, 0.022 lbs/ton) was added to the cell along with a 1 weight percent aqueous solution of 1-beta-aminoethyl-2-heptadecenyl imidazoline (Casamac® R, 0.046 lbs/ton) and the cell contents conditioned for 7 minutes while being stirred at 1250 RPM. Air was introduced into the pulp through the agitator at about 42 cubic feet per minute. The concentrate was scraped off with a paddle at 25 strokes per minute for a float of 5 minutes. After flotation, the concentrate and tails were dried and analyzed. A duplicate run was made. The results are as follows:

| | Run 1 | Run 2 | |
|---|---|---|---|
| Tails, grams | | | |
| Sample | 959.2 | 965.2 | |
| Fe | 14.10 | 11.97 | |
| Au | .249 | .415 | |
| Concentrate, grams | | | |
| Sample | 30.92 | 32.54 | |
| Fe | 1.79 | 2.05 | |
| Au | .406 | .505 | |
| % Recovery | | | Average |
| Fe | 11.3 | 14.6 | 12.9 |
| Au | 62.0 | 54.9 | 58.4 |

EXAMPLE II

This example is another control wherein the procedure described in Example I was repeated except the imidazoline collector and frother was substituted with 0.042 lbs/ton of a blend of 80 wt. % dodecyl mercaptan and 20 wt. % polypropylene glycol (molecular weight 465) frother (blend referred to as ORFOM CO120). Example II shows a slight decrease in iron recovery but a greatly increased gold recovery.

| | Run 3 | Run 4 | |
|---|---|---|---|
| Tails, grams | | | |
| Sample | 968.2 | 965.2 | |
| Fe | 11.62 | 11.52 | |
| Au | .174 | .136 | |
| Concentrate, grams | | | |
| Sample | 21.67 | 24.23 | |
| Fe | 1.19 | 1.79 | |
| Au | .617 | .760 | |
| % Recovery | | | Average |
| Fe | 9.3 | 13.4 | 11.35 |
| Au | 78.0 | 84.2 | 81.1 |

EXAMPLE III

This example is the invention that illustrates the increase in iron and gold recovery when the collectors used in Examples I and II are premixed and the blend used singularly as a collector. The procedure described in Example I was again repeated except the collector employed was a 58:42 wt. ratio blend of the imidazoline collector (Casamac® R) and the mercaptan/frother collector (ORFOM CO120). This weight ratio equates to 0.023 lbs/ton of the imidazoline collector and 0.017 lbs/ton of the mercaptan/frother collector. The results from duplicate runs using this blend are listed as follows.

| | Run 5 | Run 6 | |
|---|---|---|---|
| Tails, grams | | | |
| Sample | 966.2 | 951.8 | |
| Fe | 14.2 | 11.99 | |
| Au | .174 | .171 | |
| Concentrate, grams | | | |
| Sample | 29.94 | 31.02 | |
| Fe | 1.95 | 2.42 | |
| Au | .68 | 1.09 | |
| % Recovery | | | Average |
| Fe | 12.1 | 16.8 | 14.4 |
| Au | 79.6 | 86.4 | 83.0 |

SUMMARY

The results disclosed herein are summarized in Table I wherein it is shown that a premixed blend of the imidazoline collector and the mercaptan/frother collector give significant recoveries of iron and gold.

TABLE I

Imidazoline/Mercaptan Blends in Ore Flotation of Iron and Gold

| Collector | lbs/ton | Average % Recovery Fe | Au |
|---|---|---|---|
| Control | | | |
| A. Imidazoline[1] | .046 | 12.9 | 58.4 |
| B. Mercaptan/Frother[2] | .042 | 11.35 | 81.1 |
| Invention | | | |
| C. Imidazoline | .023 | 14.4 | 83.0 |
| D. Mercaptan/Frother | .017 | | |

[1]Casamac ® R, 1-beta-amino-2-heptadecyl imidazoline
[2]ORFOM CO120, 80% dodecylmercaptan plus 20% polypropylene glycol frother molecular weight of 465

The synergistic increase in gold recovery achieved by the imidazoline/mercaptan/frother combination is particularly significant. The gold recovery is not only above the average expected from the two results but is significantly higher than the highest recovery, although the quantity mercaptan/frother utilized is less than one-half of the quantity of mercaptan/frother used in the control runs while the quantity of imidazoline used is exactly one-half of what it was in the control runs. This synergistic effect is surprising and totally unexpected.

Reasonable variations and modifications which will become apparent to those skilled in the art can be made in this invention without departing from the spirit and scope thereof.

That which is claimed is:

1. A synergistic composition comprising as a mixture
(a) mercaptan having the formula $$R'—SH$$

wherein R' is an alkyl radical having 12 to 16 carbon atoms,
(b) an imidazoline have the formula

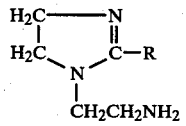

wherein R is an alkyl or alkenyl radical having from 7 to 21 carbon atoms, said imidazoline being present in the composition as such or in the form of the quarternary ammonium salt thereof,
(c) a frother.

2. A composition in accordance with claim 1 wherein said frother has the formula $$HO\left(CHR^2\underset{\underset{CH_3}{|}}{C}H—O\right)_x—R^2$$

wherein the radicals $R^2$ which can be the same or different are hydrogen, methyl or ethyl radicals and x is a number from 6 to 17.

3. Composition in accordance with claim 1 wherein said mercaptan is dodecyl mercaptan.

4. Composition in accordance with claim 1 wherein said imidazoline is 1-beta-aminoethyl-2-heptadecenyl imidazoline.

5. Composition in accordance with claim 1 wherein the weight ratio of mercaptan:frother is in the range of about 6:1 to 3:1 and wherein the weight ratio of imidazoline:mercaptan/frother is in the range of 10:90 to 90:10.

6. A flotation process comprising
(a) mixing mineral material, water and a composition as defined in one of the claims 1 to 5 to establish a pulp,
(b) aerating said pulp to produce a froth and a tail product,
(c) separating said froth from said tail product, and
(d) recovering mineral values from said froth said tail product or both from said froth and from said tail product.

7. Process in accordance with claim 6 wherein said composition is employed in a quantity in the range of 0.005 lbs/ton mineral material to 0.5 lbs/ton mineral material.

8. Process in accordance with claim 6 wherein said mineral material is crushed ore.

9. Process in accordance with claim 8 wherein said ore is a gold containing ore.

10. A synergistic ore flotation composition comprising as a mixture
(a) dodecyl mercaptan,
(b) 1-beta-aminoethyl-2-heptadecenyl imidazoline,
(c) a frother having the formula $$HO\left(CHR^2\underset{\underset{CH_3}{|}}{C}H—O\right)_x—R^2$$

wherein the radicals $R^2$ which can be the same or different are hydrogen, methyl or ethyl radicals and x is a number from 6 to 17, with the further proviso that the weight ratio of mercaptan:frother is in the range of about 6:1 to 3:1 and that the weight ratio of imidazoline:mercaptan/frother is in the range of 10:90 to 90:10.

* * * * *